US005685582A

United States Patent [19]

McCartney

[11] Patent Number: 5,685,582

[45] Date of Patent: Nov. 11, 1997

[54] SECURITY LOCK

[76] Inventor: Kevin Clair McCartney, 12243, 60 Street, Edmonton, Alberta, Canada, T5W 4A1

[21] Appl. No.: 636,343

[22] Filed: Apr. 23, 1996

[30] Foreign Application Priority Data

May 3, 1995 [CA] Canada ..... 2148511

[51] Int. Cl.[6] ..... E05C 17/54

[52] U.S. Cl. ..... 292/339; 292/259; 292/DIG. 46

[58] Field of Search ..... 292/339, 288, 292/289, 259 R, 292, DIG. 46

[56] References Cited

U.S. PATENT DOCUMENTS

| | | | |
|---|---|---|---|
| 4,073,522 | 2/1978 | Tierney | 292/288 X |
| 4,302,038 | 11/1981 | Ervine | 292/DIG. 46 X |
| 4,318,559 | 3/1982 | Burton | 292/263 |
| 4,330,146 | 5/1982 | Sessions, Jr. | 292/288 X |
| 4,429,912 | 2/1984 | Smith, Jr. | 292/DIG. 46 X |
| 4,493,501 | 1/1985 | Abel | 292/DIG. 46 X |
| 4,572,557 | 2/1986 | Taylor | 292/DIG. 46 X |
| 4,826,225 | 5/1989 | Styles | 292/DIG. 46 X |
| 5,127,689 | 7/1992 | Jarvis | 292/339 |
| 5,193,865 | 3/1993 | Allenbaugh | 292/DIG. 46 X |
| 5,294,159 | 3/1994 | Corrigan | 292/339 X |

*Primary Examiner*—Rodney M. Lindsey
*Assistant Examiner*—Monica E. Millner
*Attorney, Agent, or Firm*—Terry M. Gernstein

[57] ABSTRACT

A security lock for a sliding door or window assembly is provided. The lock comprises two pivotally connected overlapping bars having a releasable slider mechanism associated with the pivot point. The lock is adapted to sit in or above the track along which the sliding door or window moves.

3 Claims, 3 Drawing Sheets

SECURITY LOCK

FIELD OF THE INVENTION

The present invention relates to a security lock for a sliding door or window assembly.

BACKGROUND OF THE INVENTION

Frequently, sliding doors and windows are extremely vulnerable to attack by burglars because of the ease with which the door may be rocked out of its tracks. Thus one seeks to find a means of securing such doors.

Many locks and methods for securing sliding doors have been developed. An exemplary unit is disclosed in U.S. Pat. No. 4,073,522 issued to T. P. Tierney, which describes a hinged unit comprising a pair of bars pivotally linked together at their ends which in the horizontal position are adapted to fit into the channel between the edge of the sliding door and the door frame.

Deleteriously, the unit described supra, and all of those commercially available, lie directly in the track which collects dirt. The mechanical problems associated with these devices may generally be attributed to accumulated dirt and debris.

SUMMARY OF THE INVENTION

In accordance with the present invention there is provided a security lock for an assembly fitted within a frame and having a first stationary closure member in combination with a second slidable closure member, movable along a track, which comprises: a first elongate bar and a second elongate bar, said bars being substantially centrally pivotally connected, and overlapping at their central portion;

means associated with the underlying bar for releasably engaging said bars from a locked horizontal position to an unlocked angular position; and means associated with the outer ends of said bars for securing one of said bars to said slidable closure member and the second of said bars to said frame, in but preferably, above said track.

Thus, there is provided a lock suitable for both doors and windows. Preferably, a slider-stop arrangement is utilized to thereby lock the central pivot connection.

Advantageously, when the lock is secured above the track, not only is the lock more easily operable, but additionally, no accumulated dirt results and the problems associated therewith are substantially eliminated.

DESCRIPTION OF THE PREFERRED EMBODIMENT

Figure 1:
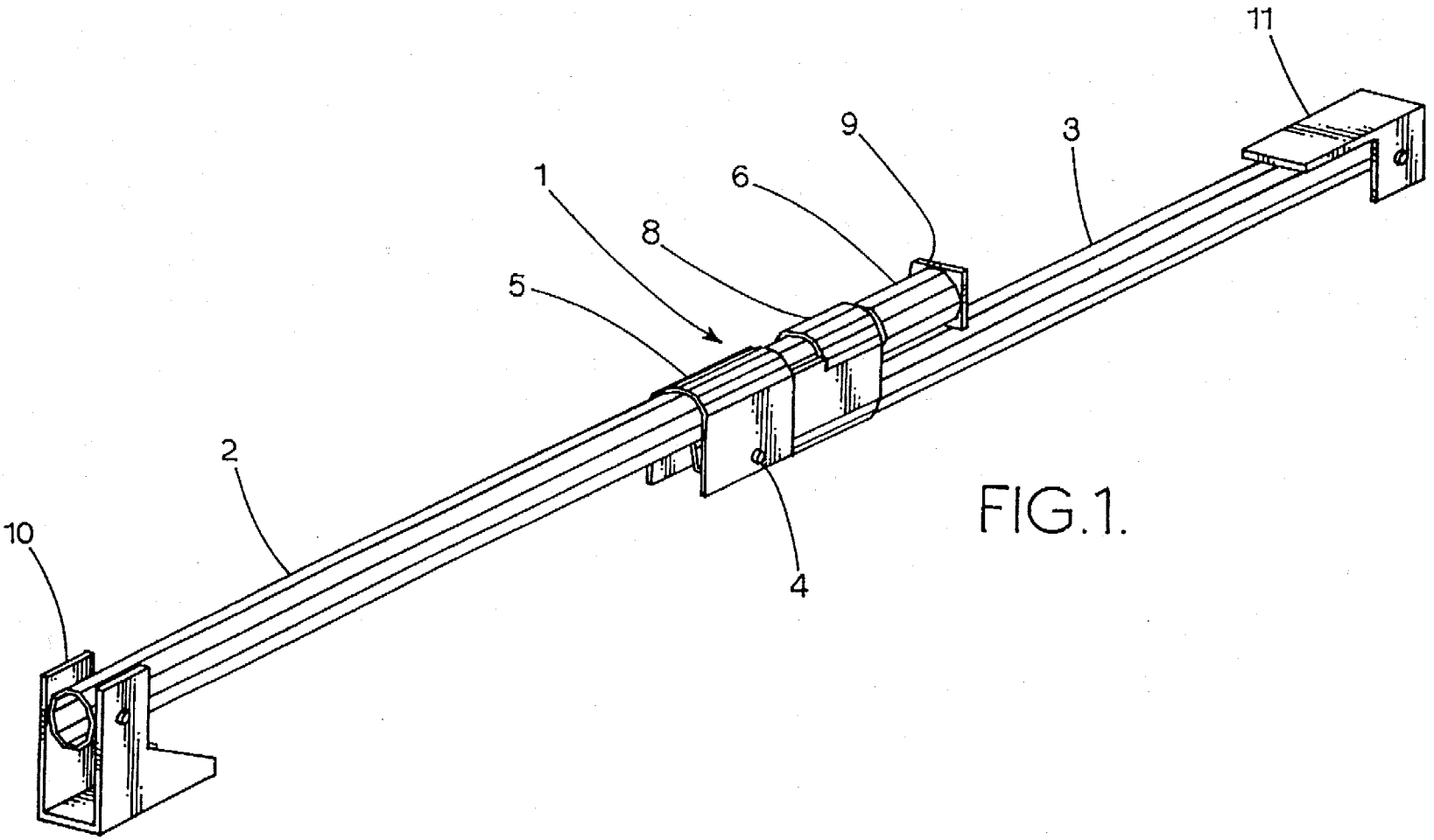
FIG. 1 illustrates the security lock of the present invention in the horizontal locked position.
Figure 2:
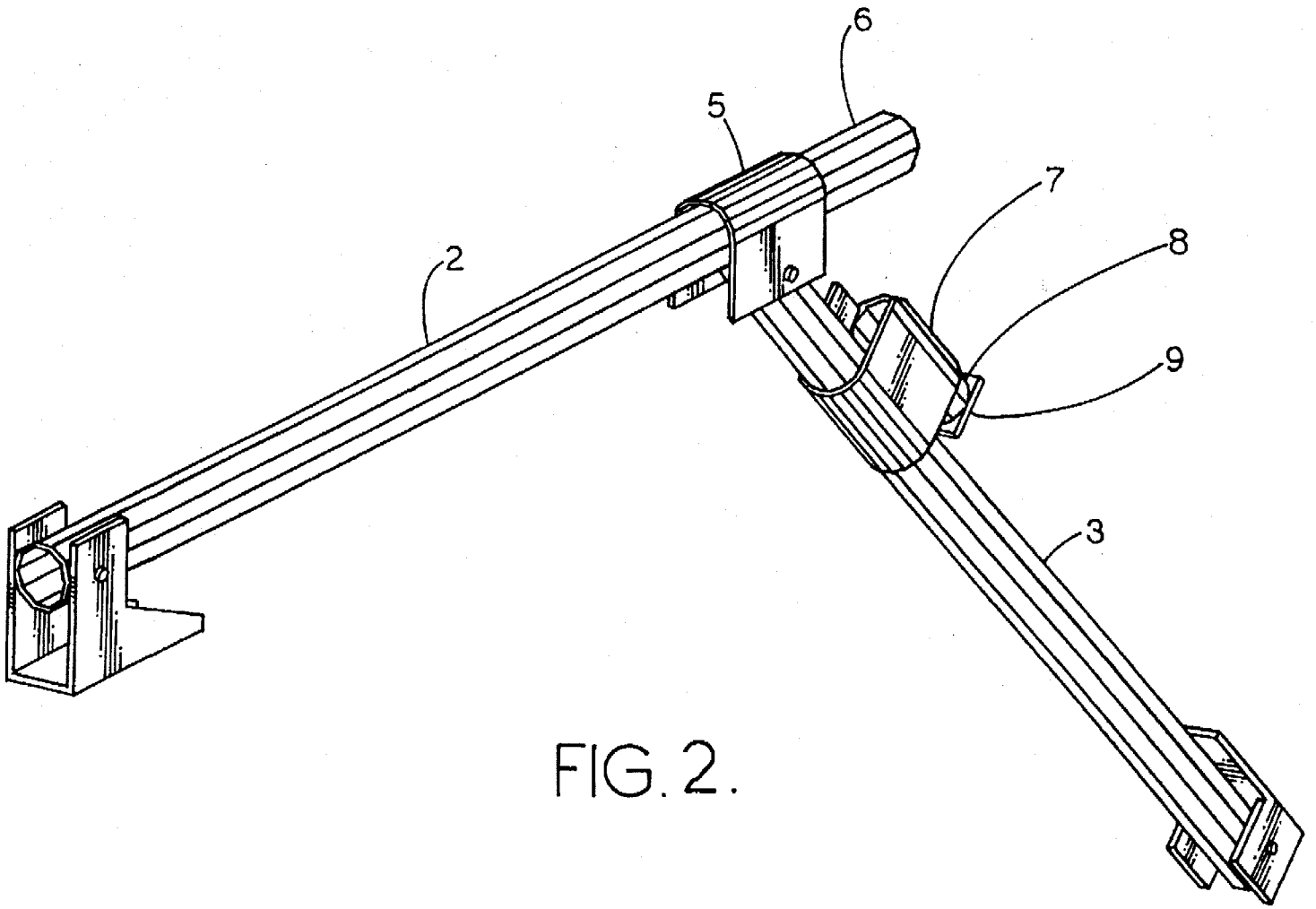
FIG. 2 shows the lock of FIG. 1 in the angular unlocked position.

Having reference to the accompanying drawings, there is shown at 1, the security lock of the present invention.

A first bar 2, is pivotally connected and overlaps a second bar 3 at pivot point 4 over which lies a pivot bracket 5. Bar 2 has a short extension 6 at its inner end.

The underlying second bar 3 defines at its inner end a movable sleeve 7 functional to slide along bar 3 and a sleeve holder 8 mounted thereabove. Sleeve holder 8 has, at its outer end a rubber sleeve stop 9. Optionally, an internal rubber safety bumper (not shown) may be positioned within sleeve 7. Thus, in operation, as clearly shown in FIG. 1, sleeve 7 is functional to slide along sleeve holder 8, being stopped at its outer end by stop 9, and at its inner end by pivot bracket 5, lying thereagainst in the horizontal locked position.

At its outer end, bar 2 forms a pivotally mounted bracket 10 which is secured to the frame of the door or window (not shown) by means of a screw or the like.

Figure 3:
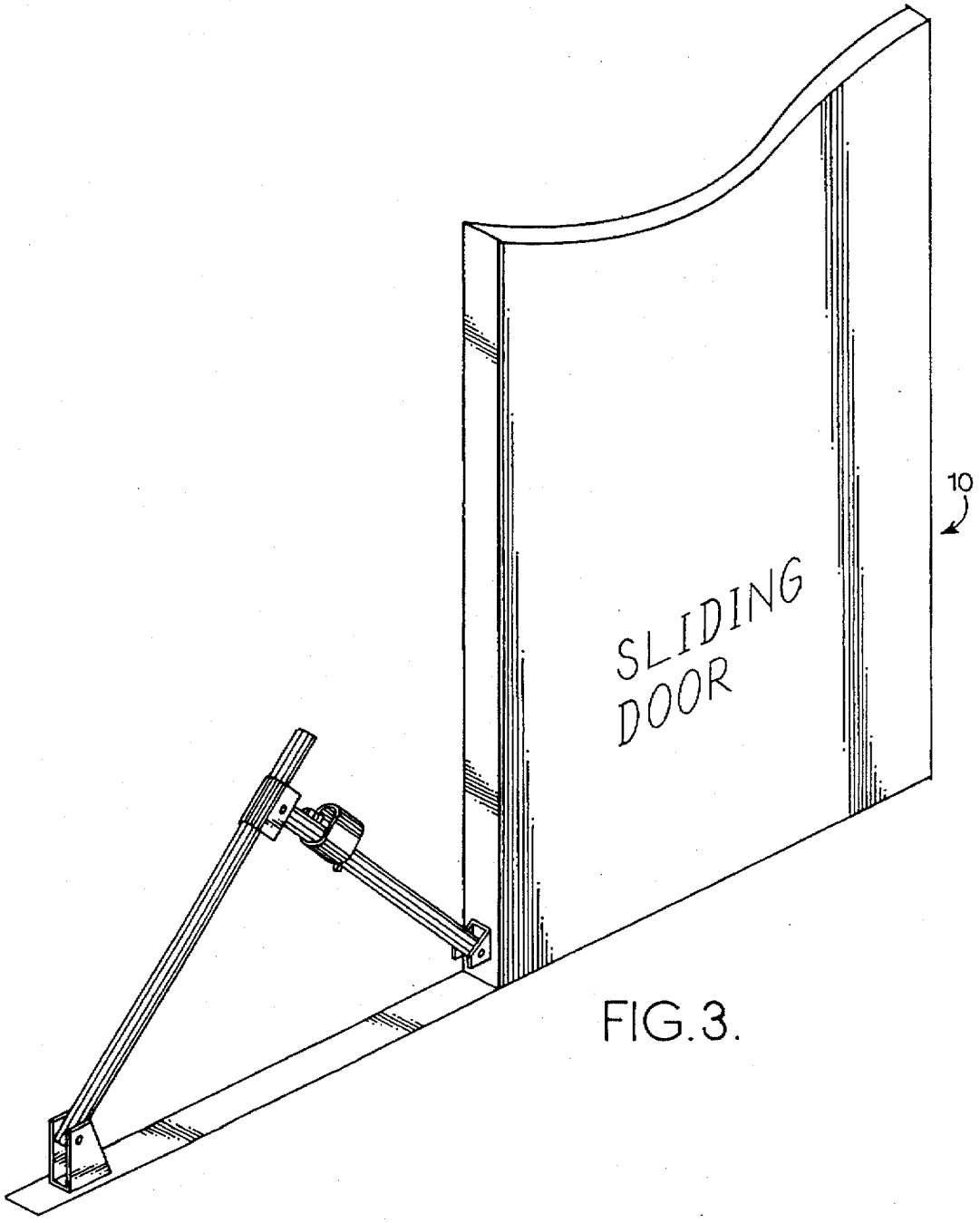
FIG. 3 depicts the lock of FIG. 1 mounted on a sliding door.

Similarly, at its outer end, bar 3 forms a pivotally mounted bracket 11, which is secured to the slidable door or window 10 by conventional methods as shown in FIG. 3.

The embodiments in which an exclusive privilege or property are claimed are defined by the claims which now follow:

1. A security device for an assembly fitted within a frame, said assembly having a first stationary closure member in combination with a second slidable closure member, said second member being slidable along a track formed in said frame, which comprises:

a first elongate bar and a second elongate bar, said bars each having inner and outer ends, said bars being substantially centrally pivotally connected, and said first bar being oriented to overlap said second bar at the inner ends of said bars whereby said first bar extends beyond said pivot point over said second bar so that said second bar is in underlying relationship to said first bar;

a slider assembly comprising a movable sleeve mounted externally around said second bar and being functional to slide a predetermined distance therealong, said sleeve being slidably mounted in a sleeve holder, said sleeve holder having a first stop member at an outer end thereof;

a second stop member mounted on said first bar, said second stop member being operative with said central pivot connection whereby said sleeve, said sleeve holder, and said second stop member releasably engage said bars in a locked horizontal position in which said bars are substantially parallel to each other when said sleeve abuts said second stop member and permits disengagement of said bars to an unlocked position in which the bars are oriented at an angle with respect to each other when the outer end of said sleeve abuts said first stop member; and means associated with the outer ends of said bars for securing one of said bars to said slidable closure member and the second of said bars to said frame.

2. A security device for locking two relatively slidable structures in position comprising:

a first bar element having a longitudinal centerline and an inner end and an outer end;

a first anchor element pivotally connected to the outer end of said first bar element and mountable on a first structure;

a second bar element having a longitudinal centerline and an inner end and an outer end;

a second anchor element pivotally connected to the outer end of said second bar element and mountable on a second structure;

at least one of said first and second structures being movable toward and away from the other structure between a first position and a second position with said first position having a spacing between said first and second structures which is greater than the spacing between said structures in said second position;

means for pivotally connecting the inner end of said second bar element to said first bar element at a location spaced from the inner end of said first bar element;

said first and second bar elements pivotally moving between a first orientation in which the longitudinal centerlines thereof extend in essentially the same direction, and a second orientation in which said bar elements extend at an angle with respect to each other, with said bar elements being transversely spaced from each other to overlap each other adjacent to the inner ends thereof when said bar elements are in said first orientation, said first bar element having a top outside surface and said second bar element having a bottom outside surface, said top outside surface being spaced from said bottom outside surface a preset spacing when said bar elements are in said first orientation;

means slidably mounted on said second bar element for locking said first and second bar elements together in said first orientation and including a sleeve slidably mounted on the outside surface of said second bar element to move between a first location and a second location, said sleeve having a bottom slidably engaging the outside surface of said second bar element and a top spaced from the outside surface of said second bar element by a distance slightly greater than said preset spacing whereby said sleeve can slide onto said first bar element to lock said first bar element to said second bar element when said sleeve is in said second location and said bar elements are in said first orientation.

3. The security device defined in claim 2 further including a stop member on said sleeve.

* * * * *